US010808910B2

(12) United States Patent
Goldmann et al.

(10) Patent No.: US 10,808,910 B2
(45) Date of Patent: Oct. 20, 2020

(54) LIGHT CONVERTING DEVICE WITH CLAMPED LIGHT CONVERTER

(71) Applicant: Lumileds LLC, San Jose, CA (US)

(72) Inventors: Claudia Goldmann, Aachen (DE); Christian Kleijnen, Ittervoort (NL); Rainald Gierth, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/340,015

(22) PCT Filed: Oct. 11, 2017

(86) PCT No.: PCT/EP2017/075917

§ 371 (c)(1),
(2) Date: Apr. 5, 2019

(87) PCT Pub. No.: WO2018/073065

PCT Pub. Date: Apr. 26, 2018

(65) Prior Publication Data

US 2020/0032981 A1 Jan. 30, 2020

(30) Foreign Application Priority Data

Oct. 17, 2016 (EP) ..... 16194142

(51) Int. Cl.
*F21S 45/47* (2018.01)
*F21V 29/70* (2015.01)
(Continued)

(52) U.S. Cl.
CPC ..... *F21S 45/47* (2018.01); *F21S 41/16* (2018.01); *F21S 41/176* (2018.01); *F21V 9/20* (2018.02); *F21V 29/70* (2015.01)

(58) Field of Classification Search
None
See application file for complete search history.

(56) References Cited

U.S. PATENT DOCUMENTS 8,459,840 B2 6/2013 Ishimori et al.
8,684,562 B2 4/2014 Ishimori et al.
(Continued)

FOREIGN PATENT DOCUMENTS

CN 102015961 A 4/2011
CN 104164234 A 11/2014
(Continued)

OTHER PUBLICATIONS

EPO as ISA, "International Search Report and Written Opinion" dated Jan. 24, 2018 from International Application No. PCT/EP2017/075917, filed Oct. 11, 2017, 11 pages.
(Continued)

*Primary Examiner* — Ashok Patel

(57) ABSTRACT

The invention describes a light converting device comprising:

a light converter for converting laser light to converted light having a longer peak emission wavelength than the laser light, a heatsink comprising a reflective structure, and a clamping structure mechanically coupling the light converter to the heatsink, the clamping structure for pressing the light converter on a surface of the heatsink such that thermal conductance between the light converter and the heatsink is increased and at least a part of the converted light is reflected by means of the reflective structure when illuminated by means of the laser light, without any adhesive or connection layer between the light converter and the heatsink.

The invention further describes a laser-based light source comprising such a light converting device, and a vehicle headlight comprising such a laser-based light source.

14 Claims, 4 Drawing Sheets

(51) Int. Cl.

| | |
|---|---|
| ***F21S 41/176*** | (2018.01) |
| ***F21S 41/16*** | (2018.01) |
| ***F21V 9/20*** | (2018.01) |

(56) References Cited

U.S. PATENT DOCUMENTS

| | | | | |
|---|---|---|---|---|
| 9,252,340 | B2 | 2/2016 | Kim et al. | |
| 9,441,155 | B2 | 9/2016 | Kishimoto et al. | |
| 9,644,817 | B2 | 5/2017 | Menkara | |
| 9,722,152 | B2 | 8/2017 | Van Bommel et al. | |
| 10,181,551 | B2 | 1/2019 | Denis | |
| 2004/0046242 | A1* | 3/2004 | Asakawa | H01L 31/0203 257/678 |
| 2009/0296384 | A1* | 12/2009 | Van De Ven | H05B 33/0803 362/231 |
| 2011/0090703 | A1 | 4/2011 | Ishimori et al. | |
| 2011/0149549 | A1 | 6/2011 | Miyake | |
| 2013/0292728 | A1 | 11/2013 | Ishimori et al. | |
| 2014/0226335 | A1 | 8/2014 | Menkara | |
| 2014/0339584 | A1 | 11/2014 | Kim et al. | |
| 2016/0027969 | A1 | 1/2016 | Denis | |
| 2016/0254420 | A1 | 9/2016 | Denis | |
| 2016/0315232 | A1 | 10/2016 | Van Bommel et al. | |

FOREIGN PATENT DOCUMENTS

| | | | |
|---|---|---|---|
| CN | 104904024 | A | 9/2015 |
| CN | 105393371 | A | 3/2016 |
| CN | 105874616 | A | 8/2016 |
| JP | 2012-226986 | * | 11/2012 |
| JP | 2012226986 | A | 11/2012 |
| WO | 2009/148176 | A1 | 12/2009 |
| WO | 2014/111822 | A1 | 7/2014 |
| WO | 2014/124325 | A1 | 8/2014 |
| WO | 2014/124325 | A4 | 8/2014 |
| WO | 2015/101535 | A1 | 7/2015 |

OTHER PUBLICATIONS

Extended European Search Report dated Mar. 20, 2017 from European Patent Application No. 16194142.2 filed Oct. 17, 2016, 7 pages.

Corrected version of WO 2009/148176 A8, Dec. 10, 2009, 1 page.

* cited by examiner

LIGHT CONVERTING DEVICE WITH CLAMPED LIGHT CONVERTER

CROSS-REFERENCE TO RELATED APPLICATIONS

The present application is a § 371 application of International Application No. PCT/EP2017/075917 filed on Oct. 11, 2017 and titled "LIGHT CONVERTING DEVICE WITH CLAMPED LIGHT CONVERTER", which claims the benefit of European Patent Application No. 16194142.2 filed on Oct. 17, 2016. International Application No. PCT/EP2017/075917 and European Patent Application No. 16194142.2 are incorporated herein.

FIELD OF THE INVENTION

The invention relates to a light converting device with clamped light converter, a laser-based light source comprising such a light converting device, and a vehicle headlight comprising such a laser-based light source.

BACKGROUND OF THE INVENTION

In high luminance light sources often a light converting device is used that is excited by e.g. blue light emitted by a laser. A phosphor of the light converting device is adhered to a heatsink by means of a layer of glue or solder which is provided between the heatsink and the phosphor. The high-intensity especially of blue laser light and the high temperature caused by the light conversion by means of the phosphor may cause reliability issues.

Instead of using such a layer of glue or solder, JP2012226986A connects a phosphor layer to a base board by using a connection section made of a material having light reflectivity, thermal conductivity, and fluidity; and fixing the phosphor layer to the base board by fixing means e.g. consisting of a fixing member covering the phosphor layer from above and being screwed to the base board.

SUMMARY OF THE INVENTION

It is an object of the present invention to provide a light converting device with improved reliability. The invention is defined by the independent claims. The dependent claims define advantageous embodiments.

According to a first aspect a light converting device is provided. The light converting device comprises a light converter. The light converter is adapted to convert laser light to converted light. A peak emission wavelength of the converted light is in a longer wavelength range than a laser peak emission wavelength of the laser light. The light converting device further comprises a heatsink comprising a reflective structure. The light converting device further comprises a clamping structure mechanically coupling the light converter to the heatsink. The clamping structure is arranged to press the light converter on a surface of the heatsink such that thermal conductance between the light converter and the heatsink is increased and at least a part of the converted light is reflected by means of the reflective structure when illuminated by means of the laser light. A lower limit of the contact pressure may, for example, be around 1 MPa, which would be equivalent to a force of 0.1 N on a phosphor with a diameter of 150 μm. The thermal conductance between the light converter and the heatsink is preferably larger than 10.000 W/(m$^2$K), more preferably larger than 50.000 W/(m$^2$K) and most preferably larger than 100.000 W/(m$^2$K). The relatively high thermal conductance between the light converter and the heatsink is enabled by the force with which the light converter is pressed on the heatsink by means of the clamping structure.

For laser sources based on blue lasers plus a light converter like a phosphor for conversion to white light, two basic setup types exist, transmissive and reflective. In the first case, the phosphor is mounted on a transparent substrate which simultaneously serves as a heatsink. In the latter case, the substrate is reflective, which implies that often a metallic heatsink is used. For both types, a crucial requirement is a low thermal resistance of the light converter to heatsink junction. Otherwise, heat removal will be hindered leading to thermal damage which can easily become catastrophic, i.e. irreversible. In order to achieve this, usually a thin layer of "connector material" or adhesive is applied between light converter and heatsink. If the connection technology used is gluing, the connector material or adhesive will be a thin layer of glue, e.g. silicone, arranged between the light converter and the heatsink. If the connection technology is soldering, a multilayer stack of solderable materials, reflective materials, and a dichroic filter to further enhance reflectivity is attached to the light converter or phosphor which is soldered on the heatsink. These "connection layers", however, lead to problems in both cases: For glued layers, the ability to withstand high temperatures and high irradiation levels without glue degradation (e.g. browning or cracking) over time is limited. For soldered layers the effort to achieve a high reflectivity at the bottom side of the phosphor is immense: The phosphor plate has to be polished, and a thick dichroic filter with a highly reflective layer and, finally, solderable metallic layers have to be applied. This is undesirable both in terms of process cost and, if the thickness of the dichroic filter approaches several μm, also in terms of thermal resistance. Furthermore, the high thermal load which may be caused by means of the conversion of the laser light may cause delamination of the multilayer stack especially between the dichroic filter and the metal layers underneath.

The light converting device with clamping structure avoids any adhesive or connection layer between the light converter and the heatsink. The contact pressure exerted by means of the clamping structure reduces thermal resistance between the light converter and the heatsink in comparison to the case in which no additional force is exerted to the light converter. Furthermore, the distance between the clamping structure and areas with high intensity of laser light and high thermal load avoids or at least limits aging of the clamping structure. The reliability issues caused by the adhesive or connection layer as described above may thus be avoided.

The clamping structure may comprise a fixing material, wherein the fixing material is arranged to press the light converter on the surface of the heatsink. The fixing material may be or comprise any material which is suitable to adhere or solder the light converter while pressing the light converter on the heatsink. The fixing material is further arranged to conserve at least a part of the contact pressure with which the light converter is pressed on the heatsink during the fixing process. The contact pressure is larger than a contact pressure caused by the mere weight of the light converter placed on the heatsink (or vice versa). The light converter may, for example, be pressed by means of a mechanical device on the heatsink and an adhesive or glue like for example silicone may be provided at one or more edges or side surfaces of the light converter in order to mechanically couple the edges of the light converter to the surface of the heatsink. The pressure is exerted as long as the adhesive or glue provides a reliable mechanical coupling between the edge or edges of the light converter and the heatsink surface. The mechanical device used during making the fixation is removed as soon as the adhesive or glue has hardened.

The fixing material may alternatively comprise a solder to fix at least one side surface of the light converter on the surface of the heatsink.

The clamping structure may alternatively comprise a mechanical structure as, for example, a clamp to press the light converter to the surface of the heatsink. The mechanical structure may be removably or permanently coupled to the heatsink.

The light converter may comprise a clamping coupler attached to the at least one side surface of the light converter. The clamping coupler may be any structure or material which is suited to enable soldering or gluing of the side surfaces of the light converter. The light converter may, for example, have a disk shape wherein a coating is provided at the side surface which enables soldering of the light converter. The light converter is pressed to the heatsink during the soldering process. The clamping coupler may alternatively be a mechanical structure like a frame arranged around the light converter. The frame may be arranged such that the light converter can be pressed to the heatsink by means of the frame. The frame or clamping coupler may further be arranged such that there is a gap between the frame and the heatsink when the light converter is pressed on the heatsink. The adhesive or solder may be arranged in the gap between the frame and the heatsink in order to couple the clamping coupler and thus the light converter to the heatsink. The clamping coupler or frame may alternatively be fixed by means of screws. The screws may be used to exert a pressure on the light converter by means of the clamping coupler in order to increase thermal conductance.

The light converter may comprise a side reflector attached to the at least one side surface of the light converter. The side reflector is arranged to reflect converted light. The side reflector may be further arranged to reflect the laser light. The side reflector may be a part of the clamping structure or clamping coupler. The side reflector may be, for example, a dichroic coating provided between the light converter and the layer which enables gluing or soldering of the light converter at the side surface.

The heatsink may comprise at least one solder pad for soldering the light converter. The at least one solder pad may be arranged to avoid spilling of solder between the light converter and the reflective structure. The solder pad may be arranged at a level which is lower than the level of the reflective structure with respect to a side of the heatsink which is opposite to the side with the reflective structure. The lower level of the solder pad in comparison to the contact area between the light converter and the heatsink may support the contact pressure between the light converter and the heatsink especially if the solder shrinks during hardening. The solder may therefore maintain the contact pressure during the fixing process during cooling.

The reflective structure or the whole area of the heatsink onto which the light converter is pressed may be solder repellent in order to avoid spilling of solder between the light converter and the reflective structure.

The reflective structure may comprise a dichroic filter and a highly reflective metal layer (e.g. silver or aluminum layer) arranged between the dichroic filter and a heat conducting material comprised by the heatsink. The heat conducting material may have a thermal conductivity of at least 20 W/(mK).

The light converting device may further comprise a clamping plate. The clamping structure may be arranged to press the light converter on the heatsink by means of the clamping plate. The clamping plate may be a transparent material which is transparent with respect to the laser light and the converted light. The transparent material may, for example, be sapphire.

The fixing material which may be an adhesive or solder may in this case be arranged to fix the clamping plate onto the light converter. The clamping plate and the light converter may both be fixed by means of the fixing material. Alternatively only the clamping plate may be fixed in order to press the light converter on the heatsink.

The fixing material may comprise glue with scattering particles. The scattering particles may be arranged to scatter the laser light or the converted light.

The clamping structure may comprise at least one clamp which is arranged to clamp the clamping plate to the light converter. The clamping structure may alternatively comprise at least one clamping holder and at least one clamping fixer. The at least one clamping holder may comprise a recess for receiving the clamping plate. The at least one clamping fixer is arranged to fix the at least one clamping holder to the heatsink. The clamping fixer may, for example, comprise a screw which can be introduced in a corresponding thread in the clamping holder.

According to a further aspect a laser-based light source is provided. The laser based light source comprises a light converting device as described above and at least one laser which is adapted to emit the laser light.

The laser-based light source may comprise two, three, four or more lasers (e.g. as an array) emitting, for example, blue laser light.

According to a further aspect a vehicle headlight is provided. The vehicle headlight comprises at least one laser-based light source as described above. The vehicle headlight may comprise two, three, four or more laser-based light sources as described above. The light converter may in this case comprise or consist of a yellow phosphor garnet (e.g. $Y_{(3-0.4)}Gd_{0.4},Al_5O_{12}$:Ce). A mixture of blue laser light and yellow converted light may be used to generate white light. Around 21% of the blue laser light may be reflected and the remaining blue laser light may be converted to yellow light. This enables a ratio of 26% blue laser light and 74% yellow converted light in the mixed light emitted by the laser-based light source by taking into account, for example, Stokes losses in the phosphor.

It shall be understood that a preferred embodiment of the invention can also be any combination of the dependent claims with the respective independent claim.

Further advantageous embodiments are defined below.

BRIEF DESCRIPTION OF THE DRAWINGS

These and other aspects of the invention will be apparent from and elucidated with reference to the embodiments described hereinafter.

The invention will now be described, by way of example, based on embodiments with reference to the accompanying drawings.

In the drawings:

Figure 1:
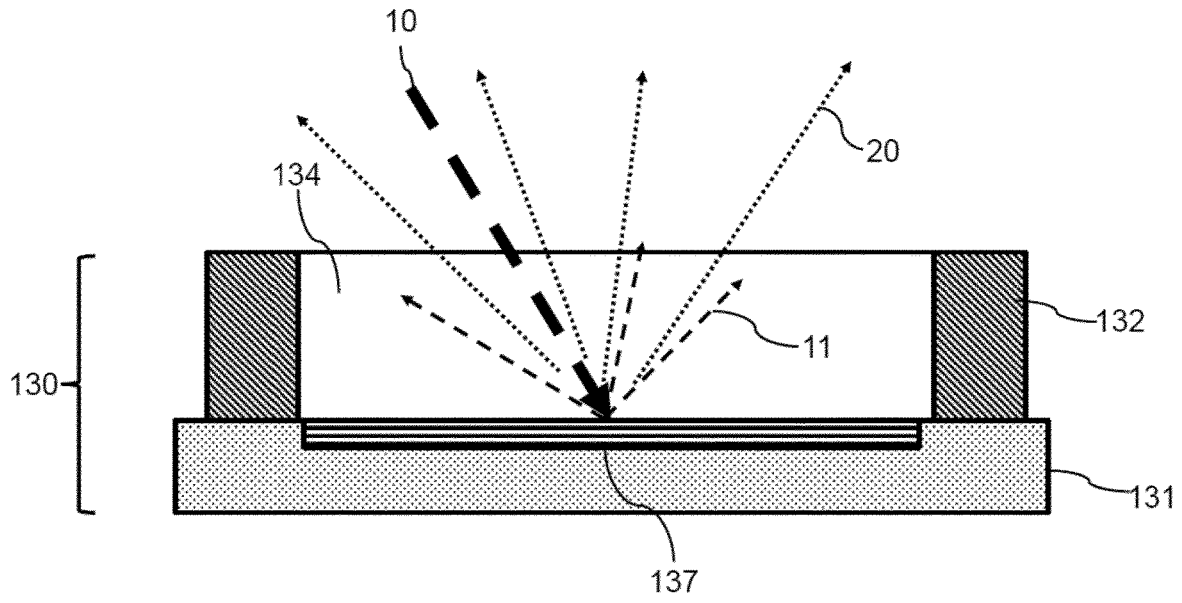
Figure 2:
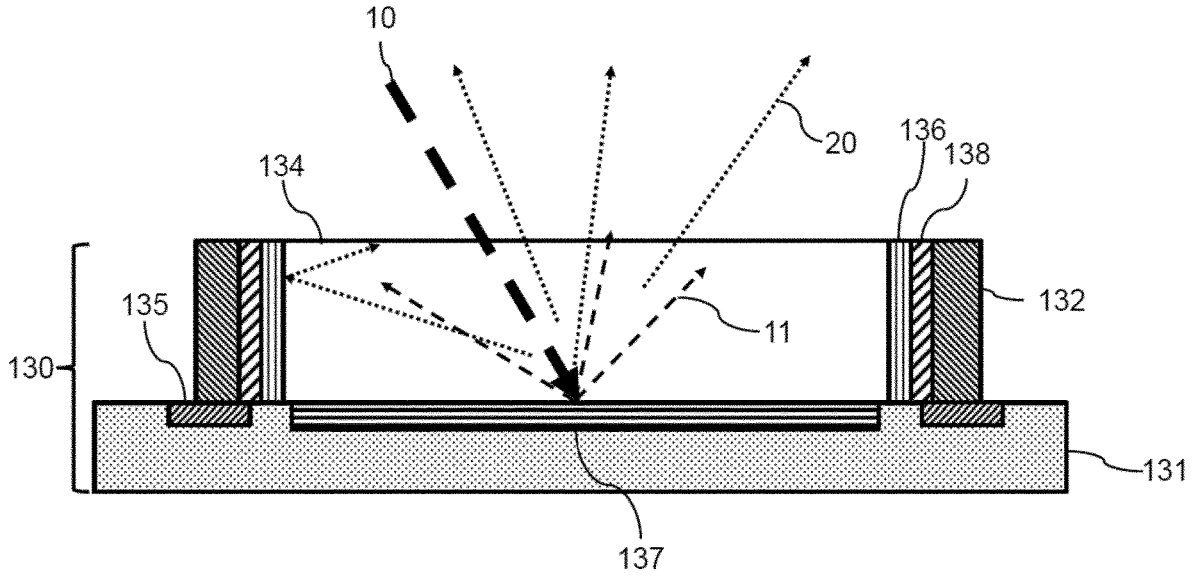
Figure 3:
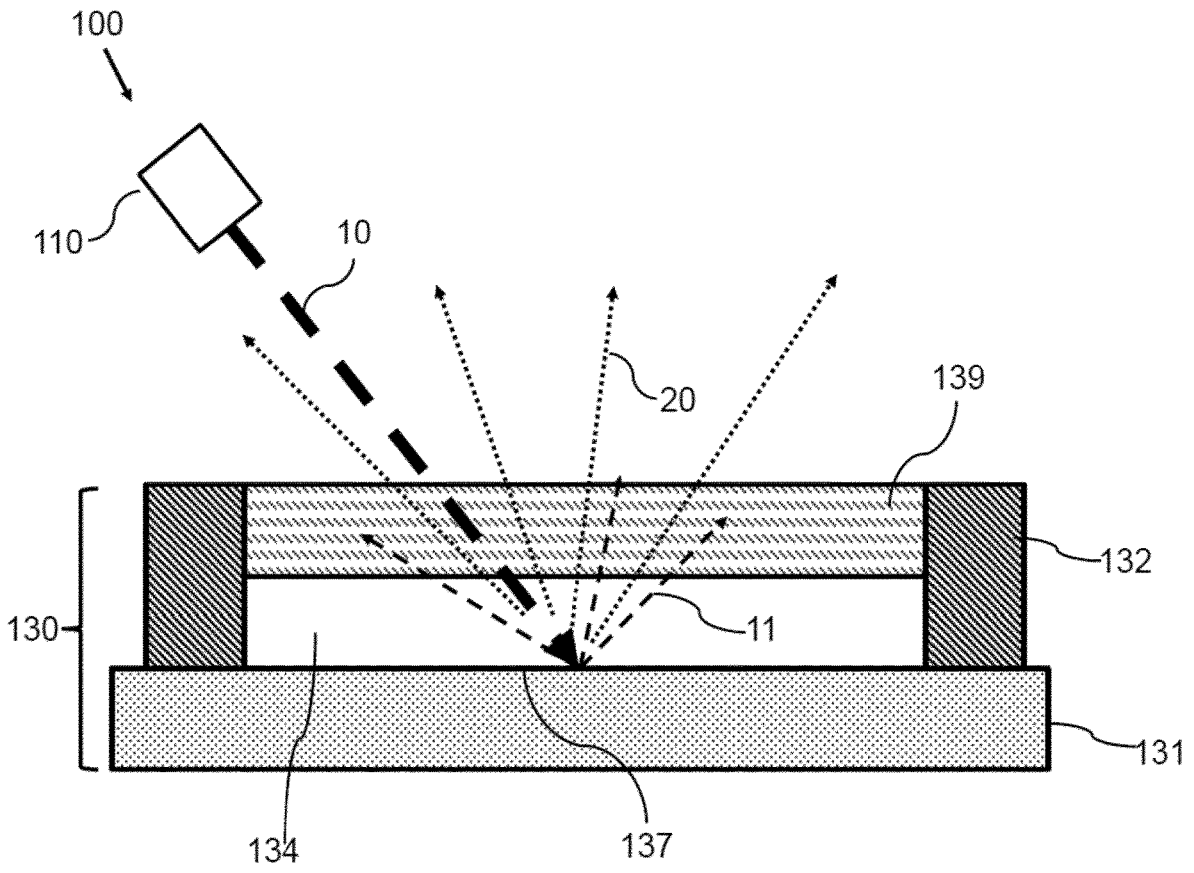
Figure 4:
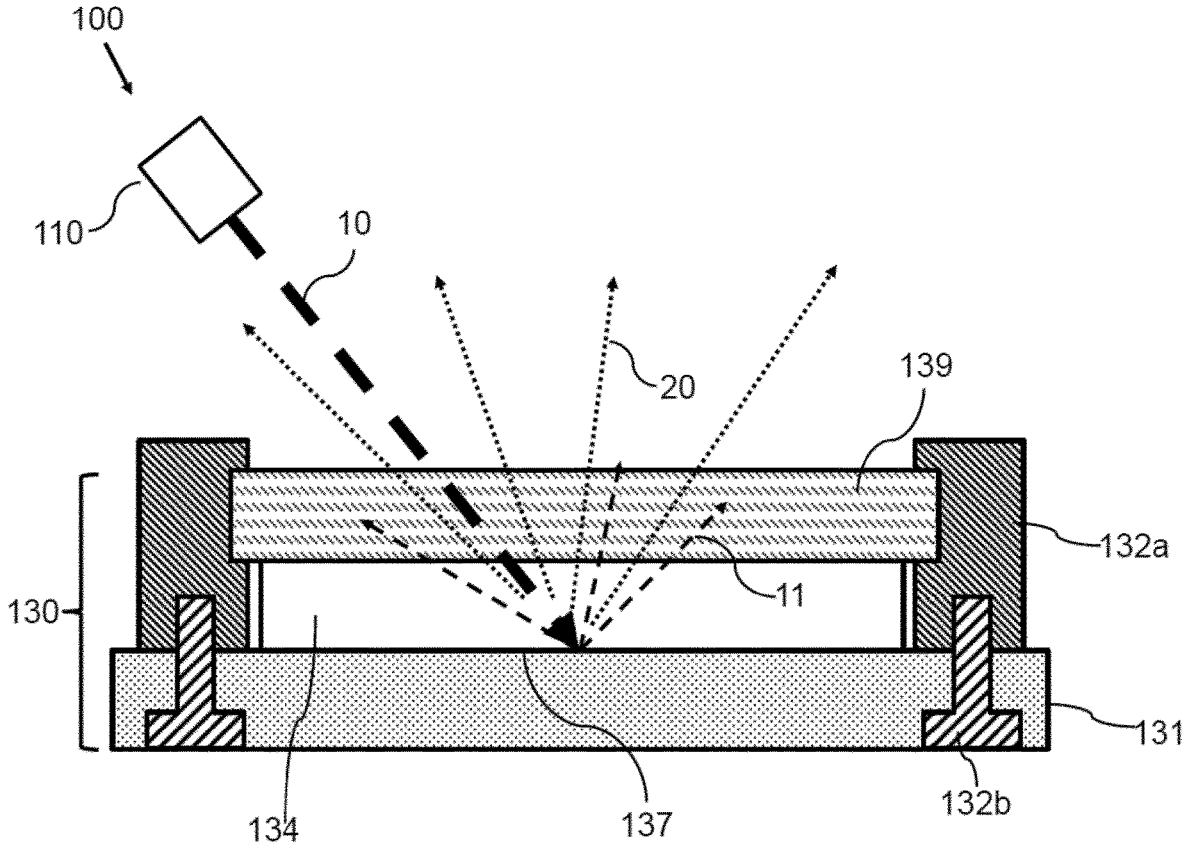
Figure 5:
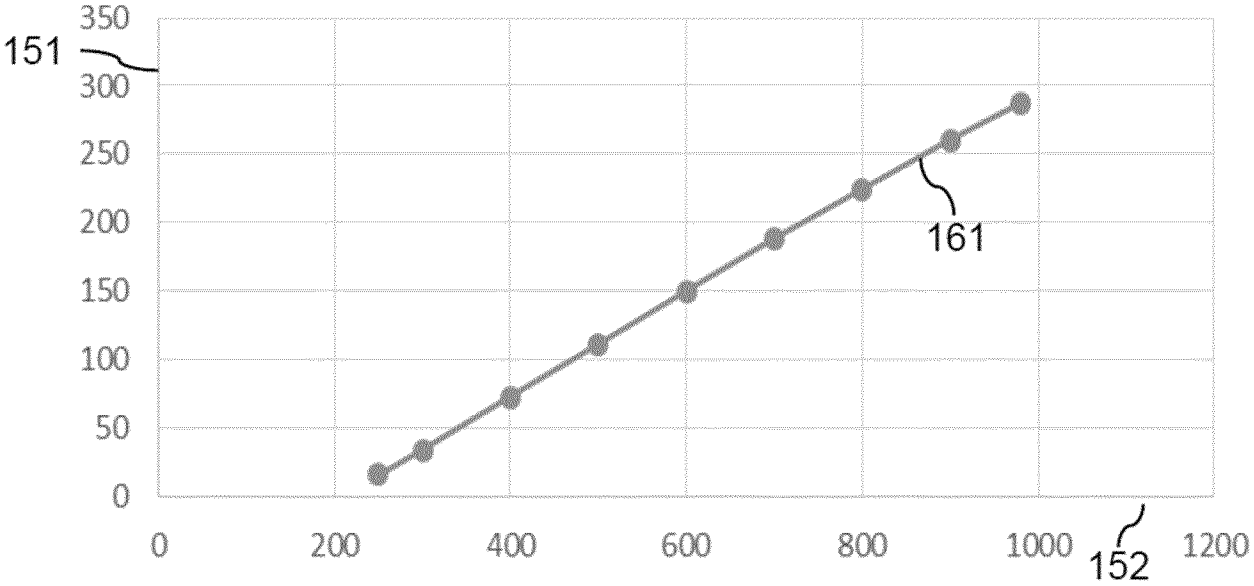

FIG. 1 shows a principal sketch of a first embodiment of a light converting device FIG. 2 shows a principal sketch of a second embodiment of a light converting device FIG. 3 shows a principal sketch of a first embodiment of a laser-based light source FIG. 4 shows a principal sketch of a second embodiment of a laser-based light source FIG. 5 shows measurement results of a laser-based light source In the Figures, like numbers refer to like objects throughout. Objects in the Figures are not necessarily drawn to scale.

DETAILED DESCRIPTION OF EMBODIMENTS

Various embodiments of the invention will now be described by means of the Figures.

FIG. 1 shows a principal sketch of a first embodiment of a light converting device 130. A light converter 134 comprising a sheet of ceramic phosphor material is pressed by means of a clamping structure 132 to a surface of a heatsink 131. A part of the surface of the heatsink 131 on which the sheet of ceramic phosphor material is pressed comprises a reflective structure 137. The reflective structure 137 is arranged to reflect laser light 10 (into reflected laser light 11) preferably in the blue wavelength range. The laser light 10 enters the light converter 134 and is at least partly converted to converted light 20. The reflective structure 137 is further arranged to reflect converted light 20 (e.g. yellow light). The clamping structure 132 is in this case silicon glue which is hardened while pressing the light converter 134 with a predefined contact pressure onto the surface of the heatsink 131. The reflective structure 137 is in this case a dichroic filter in combination with a silver layer which is provided between the dichroic filter and the surface of the heatsink 131. Simulations show the thermal resistance of such a clamp set up decreases with increasing clamping force.

| Clamping force [N] | Solid conductance [W/m$^2$K] | Gas gap conductance [W/m$^2$K] |
|---|---|---|
| 0.01 | 2688 | 107668 |
| 0.1 | 23960 | 109752 |
| 1 | 213540 | 111478 |
| 10 | 1903173 | 112898 |

The size of the phosphor is 0.3×0.3 mm. The simulation results clearly show that the thermal conductance of solid materials as well as the thermal conductance of a thin gas (air) gap increases with increasing clamping force. Both have to be taken into account because of the roughness of the surfaces. A surface roughness Ra of 3 nm of both the reflective structure 137 and light converter 134 has been assumed in the simulation presented in the table above. The clamping force may have the additional effect that the solid contact area between the light converter and the heatsink increases. The contact pressure between the light converter and the heatsink which is provided by means of the clamping structure therefore increases the thermal conductivity between the light converter and heatsink. The simulations have been verified by simulations with different surface roughness of the light converter 134 or the reflective structure 137. The results depend on the surface roughness but the general trend is the same that the thermal conductance increases with increasing contact pressure. Measurement results are discussed with respect to FIG. 5.

FIG. 2 shows a principal sketch of a second embodiment of a light converting device 130. The general set up is similar as the embodiment discussed with respect to FIG. 1. The light converter 134 is provided with side reflectors 136 at the side surfaces of the light converter 134. The side reflectors 136 are in this case a stack of thin layers with different refractive indices (e.g. alternating stack of $TiO_2$ and $SiO_2$ layers) which are deposited at the side surfaces in order to provide a dichroic mirror. The side reflectors 136 need only to limit optical losses along the relatively small side surfaces of the light converter 134. Furthermore, it is rendered unnecessary in this embodiment to polish the bottom layer of the light converter 134 which is necessary in prior art setups in order to enable sufficiently high reflectivity at the bottom layer with the thick dichroic filter which is soldered to the heatsink. A clamping coupler 138 is provided on top of the side reflector 136. The clamping coupler 138 comprises preferably a highly reflective layer such as silver or aluminum and optional further coatings (e.g. a Nickel gold finish) enabling soldering of the light converter 134 along the side surfaces. The light converter 134 with side reflectors 136 and clamping couplers 138 is pressed on a reflective structure 137 of the heatsink 131. Solder, for example gold-tin, is then provided on solder pads 135. The preferably flux free solder is heated such that a reliable connection between the solder pad 135 and the clamping coupler 138 and the side surfaces of the light converter 134 is provided. The hardened solder acts as clamping structure 132 which conserves at least a part of the contact pressure which is provided during the soldering process by means of a pressing tool. The side reflector or reflectors 136 optionally in combination with one or more metal layers of the clamping coupler 138 are arranged to reflect converted light 20 and reflected laser light 11 which is reflected, for example, at the reflective structure 137 of the heatsink 131.

FIG. 3 shows a principal sketch of a first embodiment of a laser-based light source 100. A transparent clamping plate 139 is pressed on the light converter 134 such that a contact pressure is provided between the light converter 134 and the heatsink 131. The transparent clamping plate 139 is e.g. a sapphire plate which is glued together with the light converter 134 at the side surfaces. The glue is "filled" with scattering particles e.g. $TiO_x$, particle diameter ~100 nm to a few μm; such glues are typically used for side coating of LED phosphors. The glue is dispensed around the sapphire plate and the light converter 134 (phosphor) as a side coat and is cured in place. This side coat at the same time holds the sapphire plate and phosphor down and ensures good thermal contact to the heatsink substrate provided that elasticity of the glue after curing is sufficiently suppressed by a suitable choice of glue material and curing process. The glue acts as clamping holder 132 after hardening or curing. The light converter 134 is fixed in this arrangement by the pressure provided by means of the sapphire plate and the clamping holder 132. A laser 110 is arranged to emit blue laser light 10 which enters the light converter 134 (e.g. a yellow phosphor garnet) via the sapphire plate. A part of the blue laser light 10 is converted to yellow converted light 20. A mixture of reflected blue laser light 11, which is reflected at a reflective structure 137, which is a polished surface of the heatsink 131, and converted light 20 is emitted via the sapphire plate. The laser-based light source 100 is arranged to emit white light which comprises a mixture of reflected laser light 11 and converted light 20.

This glued phosphor/heatsink package does not suffer from accidental irradiation by a too high laser power. Long-term degradation due to blue irradiation at high temperature is also no longer an issue as there is no glue layer present between phosphor and reflective structure which could be irreversibly damaged.

The side coating may further help to couple out reflected laser light 11 and converted light 20 that is guided inside the clamping plate 139. Naturally, instead of sapphire any other suitable optically (semi)transparent material can be used. High pressures during the gluing/curing process are possible, which would be critical if the pressure would be exerted on the light converter 134 only without sapphire or another cover plate. Optical losses in the cover plate are avoided by the side coating glue. Furthermore, for the assembly of the light converting device 130 only one gluing step is needed instead of the typical two steps ((1) light converter 134 to heatsink 131, (2) side coating).

FIG. 4 shows a principal sketch of a second embodiment of a laser-based light source 100. The light converter 134 is like in the embodiment discussed with respect to FIG. 3 pressed by means of a clamping plate 139 on a polished surface of a heatsink 131. The transparent clamping plate 139 is transparent with respect to laser light 10 and converted light 20. The clamping structure comprises in this case a mechanical clamping holder 132*a* and a mechanical clamping fixer 132*b*. The clamping fixers 132*b* are e.g. screws which are screwed through the heatsink 131 in corresponding threads of the clamping holder 132*a*. The clamping plate 139 is arranged e.g. in a recess of the clamping holder 132*a* such that a force can be exerted to the clamping plate 139 when the screws fix the clamping holder 132*a*. This force is used to press the light converter 134 on the heatsink 131 in order to improve thermal coupling between the light converter 134 and heatsink 131.

FIG. 5 shows measurement results of a laser-based light source. The configuration of the light converting device was very similar to the arrangement discussed with respect to FIG. 4. A sapphire clamping plate 139 was pressed on the light converter 134 in order to press the light converter 134 on the heatsink 131. The heatsink 131 was highly reflective with respect to blue laser light emitted by means of a laser and with respect to converted yellow light. The light converter was a yellow phosphor garnet (e.g. $Y_{(3-0.4)}Gd_{0.4}$, $Al_5O_{12}$:Ce). Laser light with a blue optical power of more than 6 W could be irradiated onto the set up without significant thermal quenching of the phosphor. The relative light output 151 is plotted as function 161 of laser current [mA] 152. The current at 980 mA corresponds to an optical flux of about 6 W at the phosphor target. From the almost linear curve 161 it can be deduced that the phosphor is not reaching its quenching point where a performance drop could be expected. The contact pressure of the light converter 134 on the heatsink 131 therefore enables an improved thermal conductance such that thermal quenching is avoided.

While the invention has been illustrated and described in detail in the drawings and the foregoing description, such illustration and description are to be considered illustrative or exemplary and not restrictive.

From reading the present disclosure, other modifications will be apparent to persons skilled in the art. Such modifications may involve other features which are already known in the art and which may be used instead of or in addition to features already described herein.

Variations to the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

LIST OF REFERENCE NUMERALS

10 laser light
11 reflected laser light
20 converted light
100 laser-based light source
110 laser
130 light converting device
131 heatsink
132 clamping structure
132*a* clamping holder
132*b* clamping fixer
134 light converter
135 solder pad
136 side reflector
137 reflective structure
138 clamping coupler
139 clamping plate
151 relative light output
152 laser current
161 optical power as a function of laser current

The invention claimed is:

1. A light converting device comprising:

a light converter adapted to convert laser light to converted light having a peak emission wavelength in a longer wavelength range than a laser peak emission wavelength of the laser light, a heatsink comprising a reflective structure, and a clamping structure mechanically coupling the light converter to the heatsink, the clamping structure arranged to press the light converter on a surface of the heatsink such that thermal conductance between the light converter and the heatsink is increased and at least a part of the converted light is reflected by means of the reflective structure when illuminated by means of the laser light, without any adhesive or connection layer between the light converter and the heatsink.

2. The light converting device according to claim 1, wherein the clamping structure comprises a fixing material to fix at least one side surface of the light converter on the surface of the heatsink, and wherein the fixing material is arranged to press the light converter on the surface of the heatsink.

3. The light converting device according to claim 2, wherein the fixing material comprises a solder.

4. The light converting device according to claim 2, wherein the light converter comprises a clamping coupler attached to the at least one side surface of the light converter.

5. The light converting device according to claim 2 wherein the light converter comprises a side reflector attached to the at least one side surface of the light converter, wherein the side reflector is arranged to reflect converted light.

6. The light converting device according to claim 3, wherein the heatsink comprises at least one solder pad for soldering the light converter, wherein the at least one solder pad is arranged to avoid spilling of solder between the light converter and the reflective structure.

7. The light converting device according to claim 3, wherein the reflective structure is solder repellent.

8. The light converting device according to claim 1, wherein the reflective structure comprises a dichroic filter and a highly reflective metal layer arranged between the dichroic filter and a heat conducting material comprised by the heatsink, wherein the heat conducting material has a thermal conductivity of at least 20 W/(mK).

9. The light converting device according to claim 1, further comprising a clamping plate, wherein the clamping structure is arranged to press the light converter on the heatsink by means of the clamping plate.

10. The light converting device according to claim 2, further comprising a clamping plate, wherein the clamping structure is arranged to press the light converter on the heatsink by means of the clamping plate, wherein the fixing material is further arranged to fix the clamping plate on the light converter.

11. The light converting device according to claim 10, wherein the fixing material comprises a glue with scattering particles.

12. The light converting device according to claim 9, wherein the clamping structure comprises at least one clamping holder and at least one clamping fixer, wherein the at least one clamping holder comprises a recess for receiving the clamping plate, and wherein the at least one clamping fixer is arranged to fix the at least one clamping holder to the heatsink.

13. A laser-based light source comprising:

a light converting device according to claim 1, and at least one laser, wherein the at least one laser is adapted to emit the laser light.

14. A vehicle headlight comprising at least one laser-based light source according to claim 13.

* * * * *